US012441579B2

(12) United States Patent
Oda et al.

(10) Patent No.: US 12,441,579 B2
(45) Date of Patent: Oct. 14, 2025

(54) SHEET DISCHARGING APPARATUS AND IMAGE FORMING APPARATUS

(71) Applicant: CANON KABUSHIKI KAISHA, Tokyo (JP)

(72) Inventors: Ryosuke Oda, Kanagawa (JP); Kenichi Tagami, Tokyo (JP); Keisuke Fujita, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 85 days.

(21) Appl. No.: 18/435,051

(22) Filed: Feb. 7, 2024

(65) Prior Publication Data

US 2024/0286861 A1 Aug. 29, 2024

(30) Foreign Application Priority Data

Feb. 28, 2023 (JP) ..... 2023-030437

(51) Int. Cl.
*B65H 43/06* (2006.01)
*B65H 7/02* (2006.01)
(Continued)

(52) U.S. Cl.
CPC ..... *B65H 43/06* (2013.01); *B65H 7/02* (2013.01); *B65H 31/02* (2013.01); *B65H 31/26* (2013.01);
(Continued)

(58) Field of Classification Search
CPC ..... B65H 7/02; B65H 31/02; B65H 31/26; B65H 43/06; B65H 43/08; B65H 2511/11;
(Continued)

(56) References Cited

U.S. PATENT DOCUMENTS 5,823,529 A * 10/1998 Mandel ..... B65H 39/11 271/298
5,961,115 A * 10/1999 Blanck ..... B65H 43/06 271/262
(Continued)

FOREIGN PATENT DOCUMENTS

JP 2007062865 A 3/2007
JP 2015121826 A 7/2015
(Continued)

*Primary Examiner* — Prasad V Gokhale
(74) *Attorney, Agent, or Firm* — VENABLE LLP

(57) ABSTRACT

A sheet discharging apparatus includes a discharging portion, a stacking portion, a moving member configured to move to a first position, a second position, and a third position, a detection portion, and a control portion. In a case where the detection portion detects that the moving member has reached the second position, the control portion controls the discharging portion in a first mode or a second mode. In the second mode, the control portion restricts the discharge of a sheet after a predetermined number of sheets has been discharged to the stacking portion. The control portion is configured to determine the predetermined number of sheets, depending on a type of the sheet discharged by the discharging portion, a length of the sheet in a sheet conveyance direction, and temperature and/or humidity.

7 Claims, 12 Drawing Sheets

(51) Int. Cl.
*B65H 31/02* (2006.01)
*B65H 31/26* (2006.01)

(52) U.S. Cl.
CPC ..... *B65H 2511/11* (2013.01); *B65H 2511/15* (2013.01); *B65H 2511/414* (2013.01); *B65H 2515/40* (2013.01); *B65H 2515/805* (2013.01)

(58) Field of Classification Search
CPC ..... B65H 2511/15; B65H 2511/414; B65H 2515/40; B65H 2515/805
See application file for complete search history.

(56) References Cited

U.S. PATENT DOCUMENTS

| | | | | |
|---|---|---|---|---|
| 6,113,094 | A * | 9/2000 | Horiguchi | B65H 43/06 271/176 |
| 2003/0016977 | A1 * | 1/2003 | Shiraishi | B65H 43/06 399/405 |

FOREIGN PATENT DOCUMENTS

| | | | |
|---|---|---|---|
| JP | 2015209315 | A | 11/2015 |
| JP | 2016018080 | A | 2/2016 |

* cited by examiner

SHEET DISCHARGING APPARATUS AND IMAGE FORMING APPARATUS

BACKGROUND OF THE INVENTION

Field of the Invention

The present invention relates to a sheet discharging apparatus that discharges sheets and an image forming apparatus that includes the sheet discharging apparatus.

Description of the Related Art

Japanese Patent Application Publication No. 2015-121826 proposes an image forming apparatus that includes a stacked-sheets-amount detection apparatus. The stacked-sheets-amount detection apparatus detects the amount of sheets discharged from a discharging outlet and stacked on an outer tray. The stacked-sheets-amount detection apparatus is disposed on the upper side with respect to a discharging roller pair, and includes an optical sensor, an arm-like rotor that extends from a rotary shaft into a sheet discharging space, and an arm-like sensor that extends upward from the rotary shaft. If the rotor is pushed up by sheets stacked on the outer tray, the sensor pivots on the rotary shaft. In addition, if the height of sheets stacked on a horizontal supporting surface of the outer tray becomes larger than a predetermined height, the sensor retracts from the optical path of the optical sensor, so that the level of the signal from the optical sensor changes from a LOW level to a HIGH level. If the level of the signal from the optical sensor is kept at the HIGH level, the control portion of the image forming apparatus determines that the amount of sheets stacked on the horizontal supporting surface of the outer tray has reached a maximum stacked-sheets amount, and stops the printing operation.

In addition, in a case where other sheets whose size is larger than the A4 size are printed, the control portion counts the number of printed sheets. If the number of printed sheets, counted by the control portion, reaches a threshold T, the control portion determines that the amount of sheets stacked on a sloped supporting surface of the outer tray has reached a maximum stacked-sheets amount, and stops the discharging roller pair in a state where a sheet is nipped by the discharging roller pair. As a result, the sensor is held at a retracting position, and the level of the signal from the optical sensor is kept at the HIGH level.

Thus, in the above-described stacked-sheets-amount detection apparatus, described in Japanese Patent Application Publication No. 2015-121826, the level of the signal from the optical sensor is kept at the HIGH level and the printing operation is stopped if the number of printed sheets, counted by the control portion, reaches the threshold T in a case where other sheets whose size is larger than the A4 size are printed. That is, if the level of the signal from the optical sensor becomes the HIGH level, the printing operation is stopped immediately. However, there is a case where even if the level of the signal from the optical sensor becomes the HIGH level, other types of sheets can be discharged to the outer tray. Thus, there is room for improvement in the number of sheets that can be stacked on the outer tray.

SUMMARY OF THE INVENTION

According to one aspect of the present invention, a sheet discharging apparatus includes a discharging portion configured to discharge a sheet, a stacking portion on which the sheet discharged by the discharging portion is stacked, a moving member configured to abut against the sheet stacked on the stacking portion and move to a first position, a second position, and a third position that is farther from the first position than the second position is, a detection portion configured to detect a position of the moving member, and a control portion configured to control the discharging portion. The moving member is configured to move from the first position toward the second position and the third position as a height of sheets stacked on the stacking portion increases. In a case where the detection portion detects that the moving member has reached the second position, the control portion controls the discharging portion in a first mode or a second mode, the first mode being a mode in which the control portion restricts discharge of a sheet performed by the discharging portion, the second mode being a mode in which the control portion allows the discharging portion to continue to discharge sheets even if the moving member is located between the second position and the third position. In the second mode, the control portion restricts the discharge of a sheet after a predetermined number of sheets has been discharged to the stacking portion by the discharging portion since the detection portion detected that the moving member had reached the second position. The control portion is configured to determine the predetermined number of sheets, depending on a type of the sheet discharged by the discharging portion, a length of the sheet in a sheet conveyance direction, and temperature and/or humidity.

Further features of the present invention will become apparent from the following description of exemplary embodiments with reference to the attached drawings.

DESCRIPTION OF THE EMBODIMENTS

First Embodiment

Overall Configuration

First, a first embodiment of the present invention will be described. Note that the size, material, shape, and relative arrangement of components described in the embodiments may be changed as appropriate in accordance with the configuration of an apparatus for which the present invention is applied, and with various conditions. That is, the scope of the present invention is not limited to the below-described embodiments.

Figure 1:
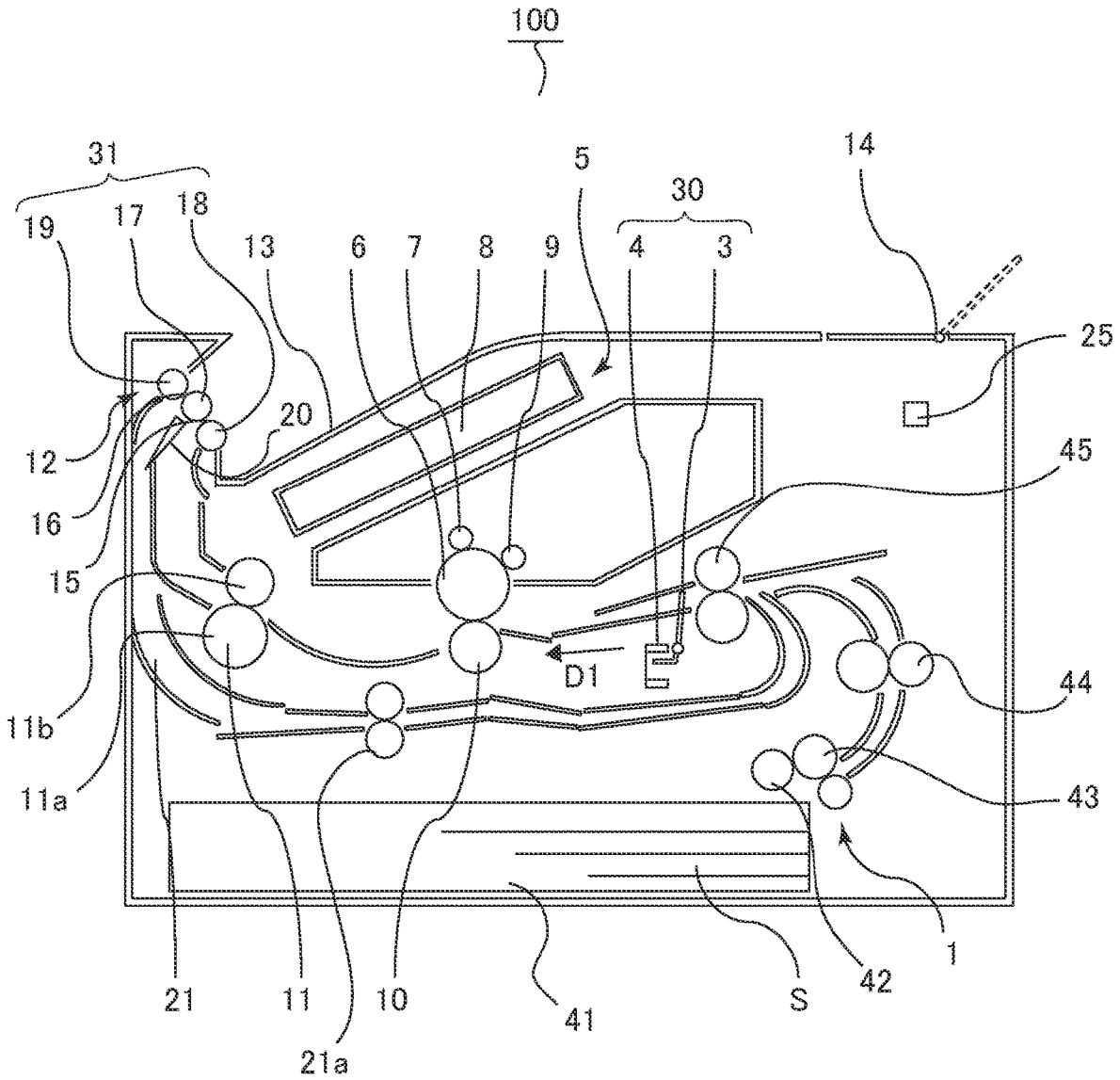
FIG. 1 is an overall schematic diagram illustrating a printer of a first embodiment.

A printer 100 that serves as an image forming apparatus is an electrophotographic laser-beam printer that forms monochrome toner images. As illustrated in FIG. 1, the printer 100 includes a sheet feeding portion 1 that feeds a sheet stack and an image forming portion 5 that forms an image on the sheet fed by the sheet feeding portion 1. The printer 100 also includes a fixing portion 11, a sheet discharging apparatus 12, a duplex conveyance portion 21, a sheet-length detection portion 30, and an environment sensor 25. The fixing portion 11 fixes an image transferred to a sheet, to the sheet, and the sheet discharging apparatus 12 discharges the sheet to the outside of the printer 100. Note that the sheet used in the present embodiment may be a paper sheet, such as a sheet for any purpose or an envelope, a plastic film such as an overhead projector (OHP) sheet, or a cloth sheet.

If an image forming command is sent to the printer 100, the image forming portion 5 starts an image forming process in accordance with the image information sent from, for example, an external computer connected to the printer 100. The image forming portion 5 includes a laser scanner 8, a photosensitive drum 6, a charging roller 7, a developing roller 9, and a transfer roller 10. The charging roller 7, the developing roller 9, and the transfer roller 10 are disposed along the photosensitive drum 6. The laser scanner 8 emits a laser beam toward the photosensitive drum 6 in accordance with the image information sent from the external computer. The photosensitive drum 6 is charged in advance by the charging roller 7. Thus, if the photosensitive drum 6 is irradiated with the laser beam, an electrostatic latent image is formed on the photosensitive drum 6. The electrostatic latent image is then developed by the developing roller 9, and a monochrome toner image is formed on the photosensitive drum 6.

In parallel with the above-described image forming process, a sheet S is fed from the sheet feeding portion 1. The sheet feeding portion 1 includes a cassette 41 on which the sheet S is stacked, a pickup roller 42, and a separation roller pair 43. The sheet S stacked on the cassette 41 is fed by the pickup roller 42, and the sheet S fed by the pickup roller 42 is separated, one by one, by the separation roller pair 43.

The sheet S separated, one by one, by the separation roller pair 43 is conveyed toward the transfer roller 10 by conveyance roller pairs 44 and 45. Then, a toner image formed on the photosensitive drum 6 is transferred onto the sheet S by an electrostatic load bias applied to the transfer roller 10. The sheet S onto which the toner image has been transferred is then applied with predetermined heat and pressure by a pressing roller 11*a* and a heating unit 11*b* of the fixing portion 11, so that the toner is melted and solidified (fixed). The heating unit 11*b* includes a heater. The sheet S having passed through the fixing portion 11 is conveyed to the sheet discharging apparatus 12.

The sheet discharging apparatus 12 includes a guide member 20, a discharging roller unit 31, a discharging tray 13 that serves as a stacking portion, and an extension tray 14. The discharging roller unit 31 includes a discharging-and-driving roller 17, a discharging-and-driven roller 18, and a reversing-and-driven roller 19. The discharging-and-driving roller 17 is driven by a motor M (see FIG. 5), and the discharging-and-driven roller 18 and the reversing-and-driven roller 19 are driven and rotated by the discharging-and-driving roller 17. That is, the discharging-and-driven roller 18 and the reversing-and-driven roller 19 are rotated by the discharging-and-driving roller 17. The discharging-and-driving roller 17 and the discharging-and-driven roller 18 form a discharging nip 15, and the discharging-and-driving roller 17 and the reversing-and-driven roller 19 form a reversing nip 16.

In a case where the single-side printing is performed for forming an image on one side of the sheet S, the sheet S conveyed by the fixing portion 11 is guided toward the discharging nip 15 by the guide member 20. Note that the guide member 20 is pivoted at an appropriate timing by an actuator (not illustrated). The sheet S is then discharged to the outside of the apparatus by the discharging nip 15, and stacked on the discharging tray 13.

In a case where the double-side printing is performed for forming images on both sides of the sheet S, the sheet S having an image formed on a first side of the sheet S is conveyed toward the reversing nip 16 by the guide member 20. The discharging-and-driving roller 17 rotates in a reverse direction after the trailing edge of the sheet S passes the guide member 20. With this operation, the sheet S is switch-backed by the reversing nip 16, and is conveyed toward the duplex conveyance portion 21.

The sheet S conveyed to the duplex conveyance portion 21 is conveyed again toward the conveyance roller pair 45 by a conveyance roller pair 21*a*. Then an image is formed on a second side of the sheet S by the transfer roller 10, and the sheet S is discharged to the discharging tray 13 by the discharging nip 15.

The extension tray 14 is disposed in the discharging tray 13, and can pivot between a storage position indicated by a solid line in FIG. 1 and an unfolded position indicated by a broken line in FIG. 1. For example, in a case where a long sheet is discharged by the discharging nip 15, a user pivots the extension tray 14 from the storage position to the unfolded position. Thus, the leading edge of the sheet S is supported by the extension tray 14 positioned in the unfolded position, so that the sheet S discharged onto the discharging tray 13 can be prevented from falling from the discharging tray 13. The sheet-length detection portion 30 and the environment sensor 25 will be described below.

Full-Load Detection Apparatus

Figure 2:
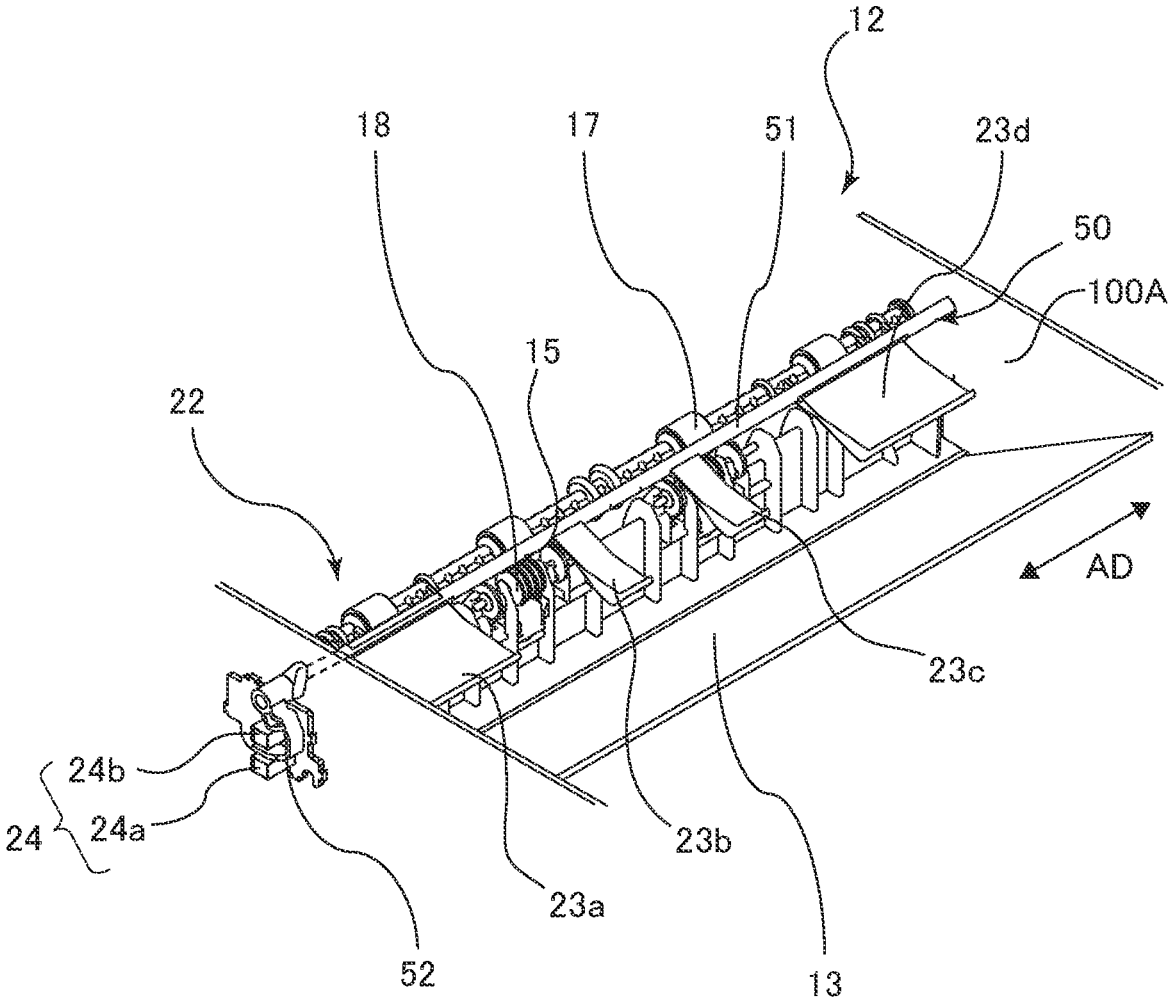
FIG. 2 is a perspective view illustrating a sheet discharging apparatus.

Next, a full-load detection apparatus 22 of the sheet discharging apparatus 12 will be described in detail. As illustrated in FIG. 2, the sheet discharging apparatus 12 includes the full-load detection apparatus 22 disposed for preventing the discharging tray 13 from being overloaded with sheets S. The full-load detection apparatus 22 includes a full-load detection member 50 that serves as a moving member, and a full-load detection sensor 24 that serves as a detection portion. The full-load detection member 50 includes a pivot shaft 51; flag portions 23*a*, 23*b*, 23*c*, and 23*d*; and a light blocking portion 52. The pivot shaft 51 is pivotally supported by a housing 100A of the printer 100.

The flag portions 23*a*, 23*b*, 23*c*, and 23*d* are fixed to the pivot shaft 51, and extend in a radial direction orthogonal to an axial direction AD of the pivot shaft 51. In addition, the flag portions 23*a*, 23*b*, 23*c*, and 23*d* are disposed adjacent to each other in the axial direction AD, and are symmetric in the axial direction AD, with respect to the center of the conveyance path. In this arrangement, the flag portions 23*a*, 23*b*, 23*c*, and 23*d* can abut against a variety of sizes of sheets discharged by the discharging nip 15.

Note that the flag portions 23*a*, 23*b*, 23*c*, and 23*d* have the same structure and effects. Thus, the flag portions 23*a*, 23*b*, 23*c*, and 23*d* will be simply described and illustrated as a flag portion 23 in the following description and figures if the description is made for the flag portions 23*a*, 23*b*, 23*c*, and 23*d* without distinguishing each of them.

The light blocking portion 52 is fixed to one end portion of the pivot shaft 51 in the axial direction AD, and can block an optical path 24*c* (see FIG. 3B) of the full-load detection sensor 24 fixed to the housing 100A. The full-load detection sensor 24 serves as a detection portion, and includes a light emitting portion 24*a* and a light receiving portion 24*b*. The full-load detection sensor 24 turns ON if the light receiving portion 24*b* receives the light emitted from the light emitting portion 24*a*. In other words, the full-load detection sensor 24 may be constituted by a photointerrupter and changes its output value, depending on whether the light receiving portion 24*b* receives the light. The optical path 24*c* is formed between the light emitting portion 24*a* and the light receiving portion 24*b*. The pivot shaft 51, the flag portions 23*a*, 23*b*, 23*c*, and 23*d*, and the light blocking portion 52 of the full-load detection member 50 pivot (or move) as one body.

Figure 3A:
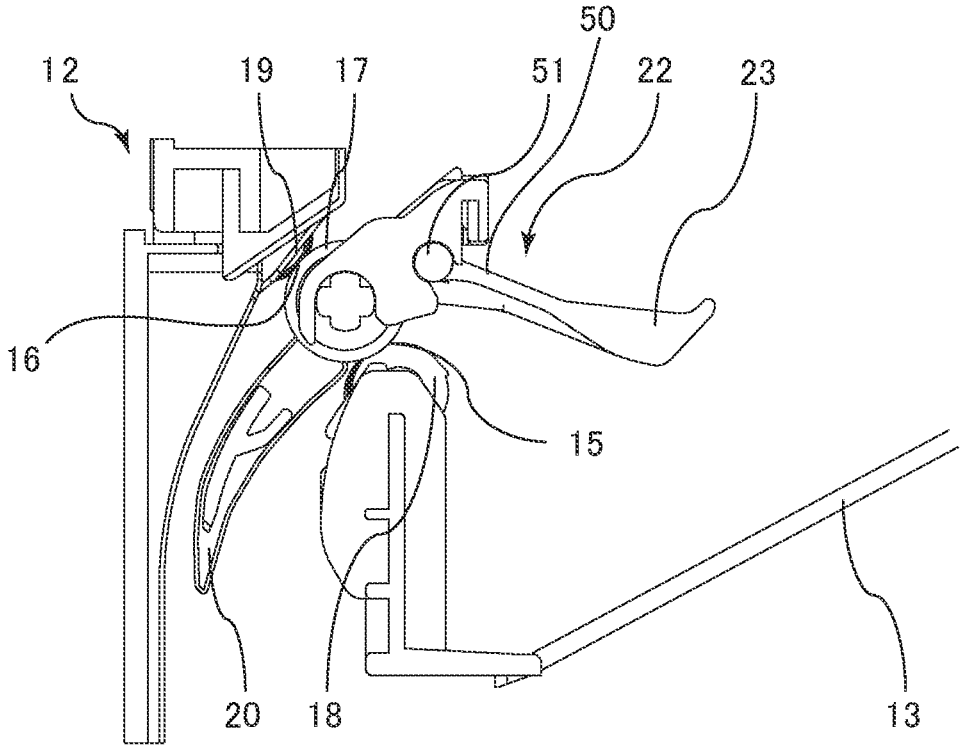
FIG. 3A is a cross-sectional view illustrating a full-load detection member located in a standby position.
Figure 3B:
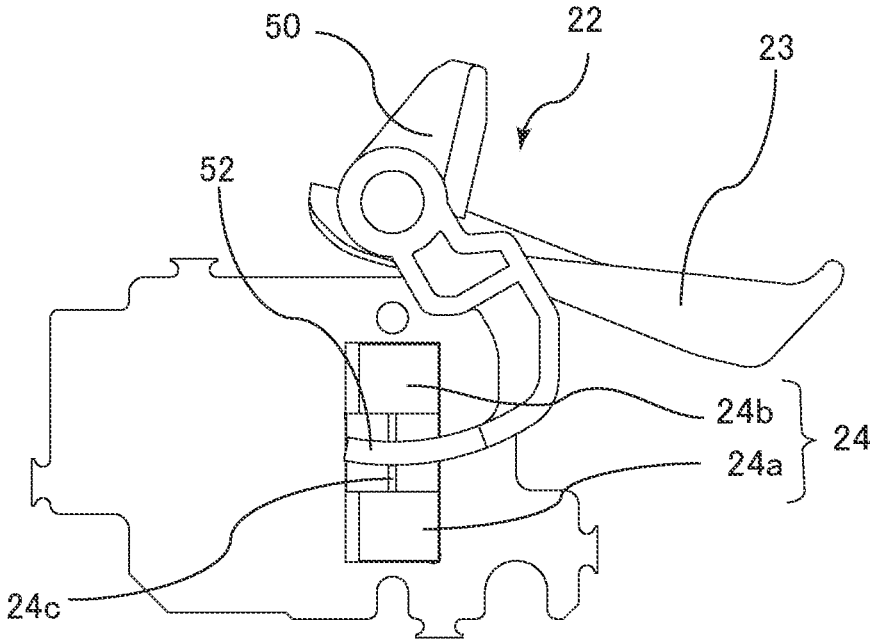
FIG. 3B is a cross-sectional view illustrating the full-load detection member located in the standby position, and a full-load detection sensor.
Figure 4A:
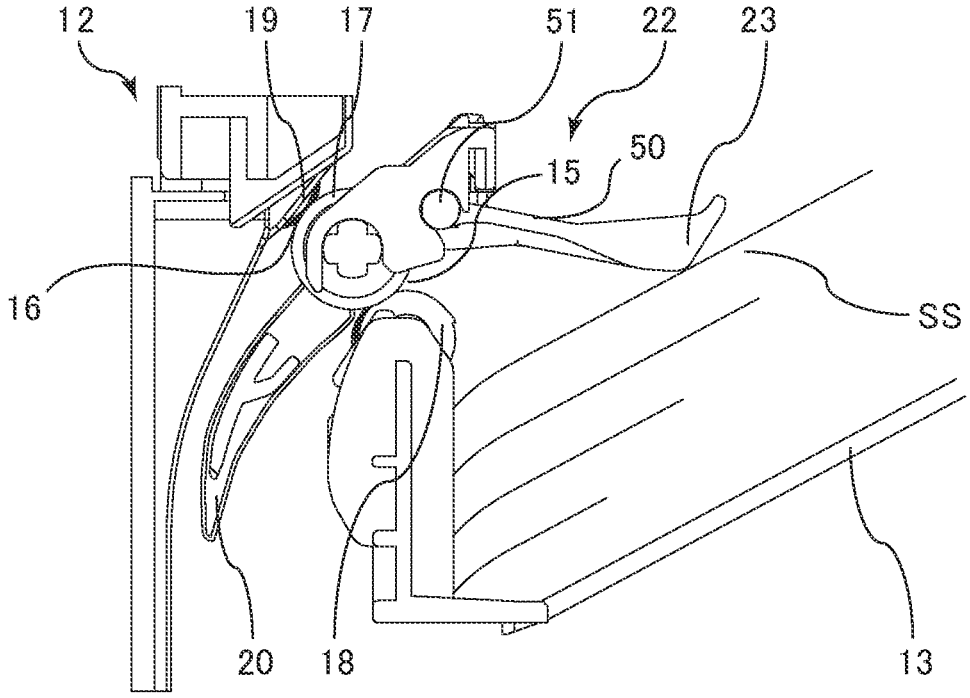
FIG. 4A is a cross-sectional view illustrating the full-load detection member located in a detection position.

As illustrated in FIGS. 3A and 4A, the sheet S discharged from the discharging roller unit 31 is stacked on the discharging tray 13. The flag portion 23 of the full-load detection member 50 is lifted temporarily by the sheet S conveyed by the discharging roller unit 31, and descends when the trailing edge of the sheet S passes the discharging roller unit 31. The state where the flag portion 23 of the full-load detection member 50 has descended after the flag portion 23 was lifted temporarily by the sheet is hereinafter referred to as a descent state of the flag portion 23. In addition, the sheets stacked on the discharging tray 13 are hereinafter referred to as stacked sheets. If the height of the stacked sheets is smaller than a predetermined height, the flag portion 23 of the full-load detection member 50 in the descent state does not abut against the stacked sheets, and is located in a standby position illustrated in FIG. 3A and serving as a first position. As illustrated in FIG. 3B, in a state where the flag portion 23 that serves as an abutment portion is located in the standby position, since the light blocking portion 52 blocks the optical path 24*c* of the full-load detection sensor 24, the full-load detection sensor 24 is in an OFF state (i.e., a light block state).

If the height of the stacked sheets becomes equal to the predetermined height, the top surface of the uppermost sheet of the stacked sheets abuts against the flag portion 23 that is in the descent state. In addition, the position at which the flag portion 23 in the descent state abuts against the top surface of the stacked sheets is shifted upward as the height of the stacked sheets increases. In other words, the position of the flag portion 23 that abuts against the top surface of the stacked sheets is shifted from the standby position toward a below-described detection position as the number of sheets stacked on the discharging tray 13 increases.

When the flag portion 23 is located in a position illustrated in FIG. 4A, that is, when the flag portion 23 is in contact with the top surface of the uppermost sheet of a full load of stacked sheets SS, the flag portion 23 is located in the detection position that serves as a second position. In other words, if the flag portion 23 abuts against sheets stacked on the discharging tray 13, at a position higher than the predetermined position, the flag portion 23 is located in the detection position. In this manner, the full-load detection member 50 that includes the flag portion 23 moves in accordance with the height of the stacked sheets.

Figure 4B:
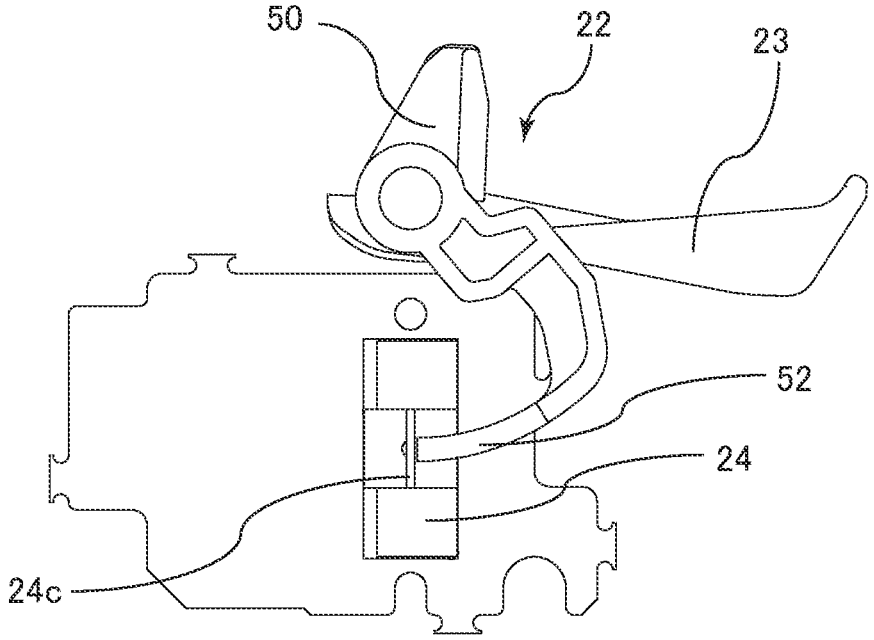
FIG. 4B is a cross-sectional view illustrating the full-load detection member located in the detection position, and the full-load detection sensor.

As illustrated in FIG. 4B, in a state where the flag portion 23 is located in the detection position, the light blocking portion 52 does not block the optical path 24*c* of the full-load detection sensor 24, and the full-load detection sensor 24 is in an ON state (i.e., a light transmission state). In a state before the flag portion 23 reaches the detection position, the light blocking portion 52 blocks the optical path 24*c* of the full-load detection sensor 24, and the full-load detection sensor 24 is in an OFF state (i.e., a light block state).

That is, if the number of stacked sheets SS increases and the full-load detection member 50 reaches the detection position, the state of the full-load detection sensor 24 changes from the OFF state to the ON state. Note that in the following description, when the flag portion 23 is located in the standby position, the full-load detection member 50 is also located in the standby position. Similarly, when the flag portion 23 is located in the detection position, the full-load detection member 50 is also located in the detection position. In addition, when the flag portion 23 is in the descent state, the full-load detection member 50 is also in the descent state. Note that the light blocking portion 52 and the full-load detection sensor 24 may be configured so that the light blocking portion 52 blocks the optical path 24*c* of the full-load detection sensor 24 when the flag portion 23 is located between the detection position and a below-described upper position (see FIG. 9A), and does not block the optical path 24*c* of the full-load detection sensor 24 when the flag portion 23 is located between the standby position and the detection position.

Control Block

Figure 5:
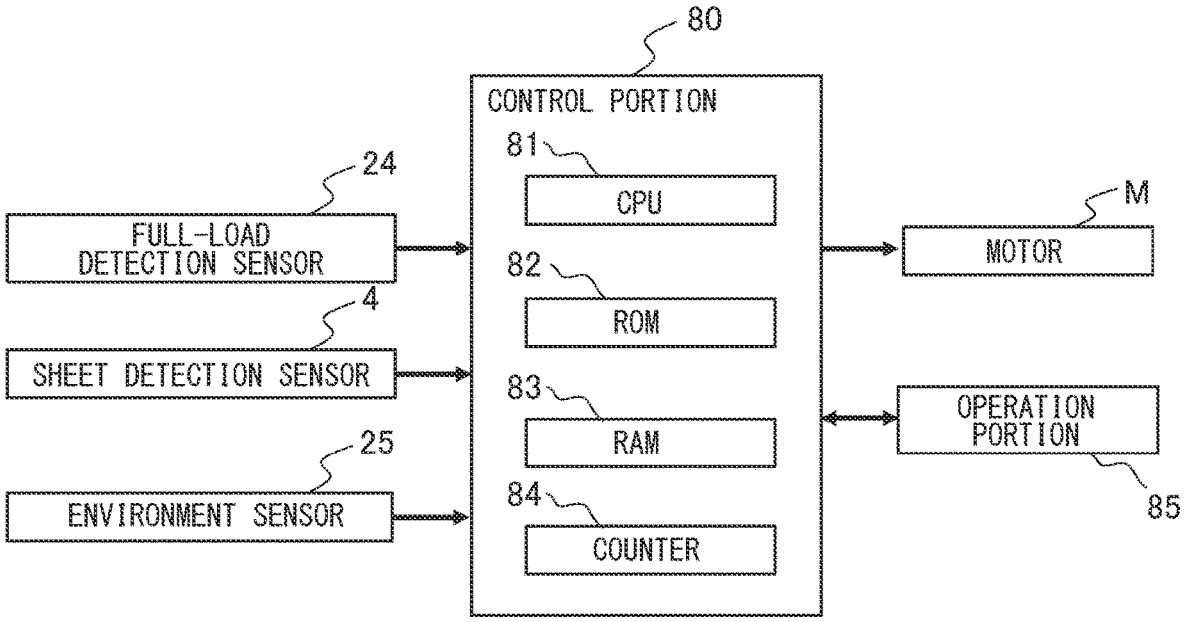
FIG. 5 is a block diagram illustrating control blocks of the printer.

FIG. 5 is a block diagram illustrating control blocks of the printer 100 of the present embodiment. As illustrated in FIG. 5, the printer 100 includes a control portion 80. The control portion 80 includes a central processing unit (CPU) 81, a read only memory (ROM) 82, a random access memory (RAM) 83, and a counter 84. The ROM 82 stores various programs, and the CPU 81 reads and executes a program stored in the ROM 82. The RAM 83 is used as a work area of the CPU 81. The counter 84 counts the number of sheets S discharged by the discharging nip 15.

The full-load detection sensor 24, the sheet detection sensor 4, and the environment sensor 25 are connected to an input portion of the control portion 80. As illustrated in FIG. 1, the printer 100 includes the sheet-length detection portion 30, and the sheet-length detection portion 30 includes a sheet detection flag 3 and a sheet detection sensor 4. The sheet detection flag 3 is urged by a spring (not illustrated) such that the sheet detection flag 3 can move. Note that although the sheet detection flag 3 is disposed, in the present embodiment, downstream of the conveyance roller pair 45 in a sheet conveyance direction D1, the present disclosure is not limited to this. That is, the sheet detection flag 3 may be disposed in any position as long as the sheet detection flag 3 can abut against the sheet conveyed in the conveyance path.

Figure 6:
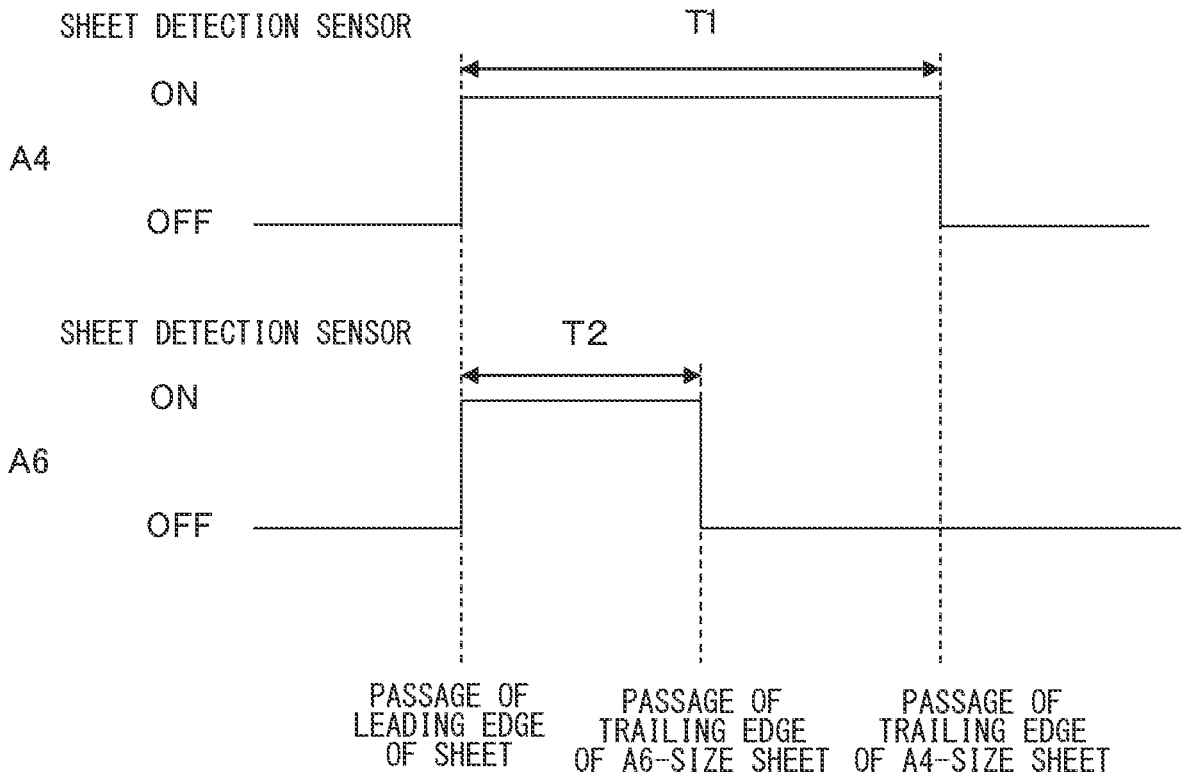
FIG. 6 is a diagram illustrating a signal from a sheet detection sensor.

As illustrated in FIG. 6, if the sheet detection flag 3 is pressed and moved by the leading edge of the sheet conveyed, the state of the sheet detection sensor 4 changes from an OFF state to an ON state. In addition, when the trailing edge of the sheet passes the sheet detection flag 3, the sheet detection flag 3 is returned to a standby position by the spring (not illustrated), and the state of the sheet detection sensor 4 changes from the ON state to the OFF state. The length of the sheet in the sheet conveyance direction D1 is calculated from the time in which the sheet detection sensor 4 is in the ON state, and the sheet conveyance speed.

For example, if an A4-size sheet is conveyed, the time in which the sheet detection sensor 4 is in the ON state is a time T1; if an A6-size sheet is conveyed, the time in which the sheet detection sensor 4 is in the ON state is a time T2. Thus, the length of a sheet (an A4-size sheet or an A6-size sheet conveyed) in the sheet conveyance direction D1 can be detected by multiplying the time T1 or T2 by the sheet conveyance speed.

As illustrated in FIG. 1, the environment sensor 25 is disposed in the printer 100 and detects the ambient temperature. That is, the environment sensor 25 detects the temperature around the sheet discharging apparatus 12. In the present embodiment, depending on the temperature detected by the environment sensor 25, the control portion 80 determines the environment as one of three environments: a normal-temperature and normal-humidity environment, a high-temperature and high-humidity environment, and a low-temperature and low-humidity environment. In the present embodiment, as an example, the control portion 80 determines the environment as the normal-temperature and normal-humidity environment if the temperature detected by the environment sensor 25 is equal to or higher than 19° C. and equal to or lower than 27° C., the low-temperature and low-humidity environment if the temperature is lower than 19° C., and the high-temperature and high-humidity environment if the temperature is higher than 27° C.

Note that the thresholds for determining the environment are not limited to the above-described temperatures, and may be set as appropriate. In addition, although the control portion 80 determines, in the present embodiment, the environment as one of three environments: the normal-temperature and normal-humidity environment, the high-temperature and high-humidity environment, and the low-temperature and low-humidity environment, depending on the temperature detected by the environment sensor 25, the control portion 80 may determine the environment as one of less than three environments or four or more environments.

In addition, although the control portion 80 determines, in the present embodiment, the environment as one of three environments: the normal-temperature and normal-humidity environment, the high-temperature and high-humidity environment, and the low-temperature and low-humidity environment, depending on the temperature detected by the environment sensor 25, the environment sensor 25 may detect the humidity, instead of the temperature. In this case, the control portion 80 may determine the environment as one of three environments: the normal-temperature and normal-humidity environment, the high-temperature and high-humidity environment, and the low-temperature and low-humidity environment, depending on the humidity detected by the environment sensor 25. In another case, the environment sensor 25 may detect the temperature and the humidity. In this case, the control portion 80 may determine the environment as one of three environments: the normal-temperature and normal-humidity environment, the high-temperature and high-humidity environment, and the low-temperature and low-humidity environment, depending on the temperature and the humidity detected by the environment sensor 25. Also in this case, the environments from which an environment is determined is not limited to the three environments: the normal-temperature and normal-humidity environment, the high-temperature and high-humidity environment, and the low-temperature and low-humidity environment. That is, the control portion 80 may determine the environment as one of less than three environments or four or more environments.

A motor M is connected to an output portion of the control portion 80. The motor M drives the discharging-and-driving roller 17 of the discharging roller unit 31. The control portion 80 controls the discharging roller unit 31, which serves as a discharging portion, by controlling the motor M.

In addition, an operation portion 85 is connected to the control portion 80. The operation portion 85 includes a liquid crystal panel and physical buttons. Thus, a user can specify the type (grammage) of a sheet discharged by the discharging nip 60, and the length of the sheet in the sheet conveyance direction D1, via the operation portion 85.

Full-Load Detection Control

Figure 7:
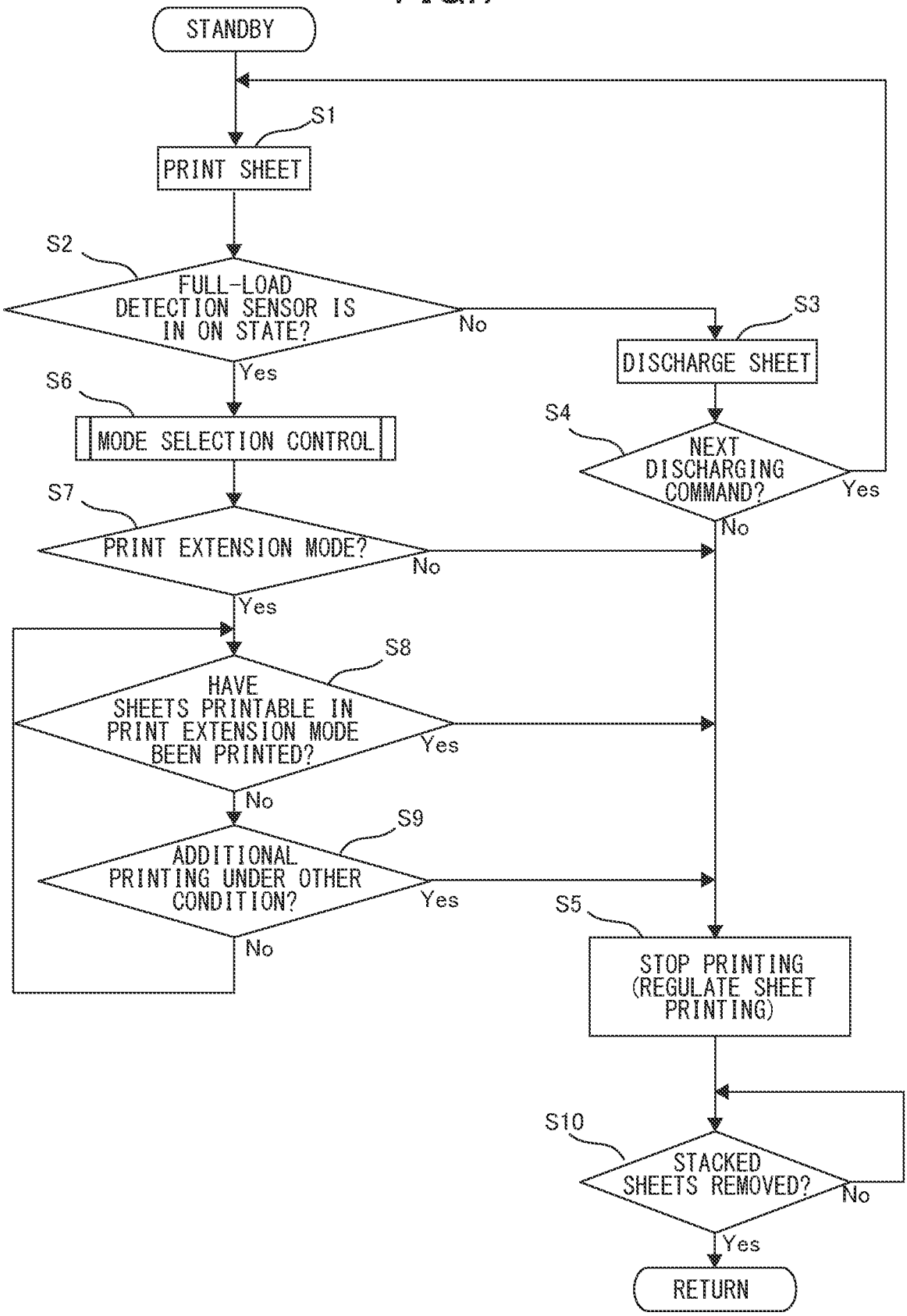
FIG. 7 is a flowchart illustrating full-load detection control.
Figure 8:
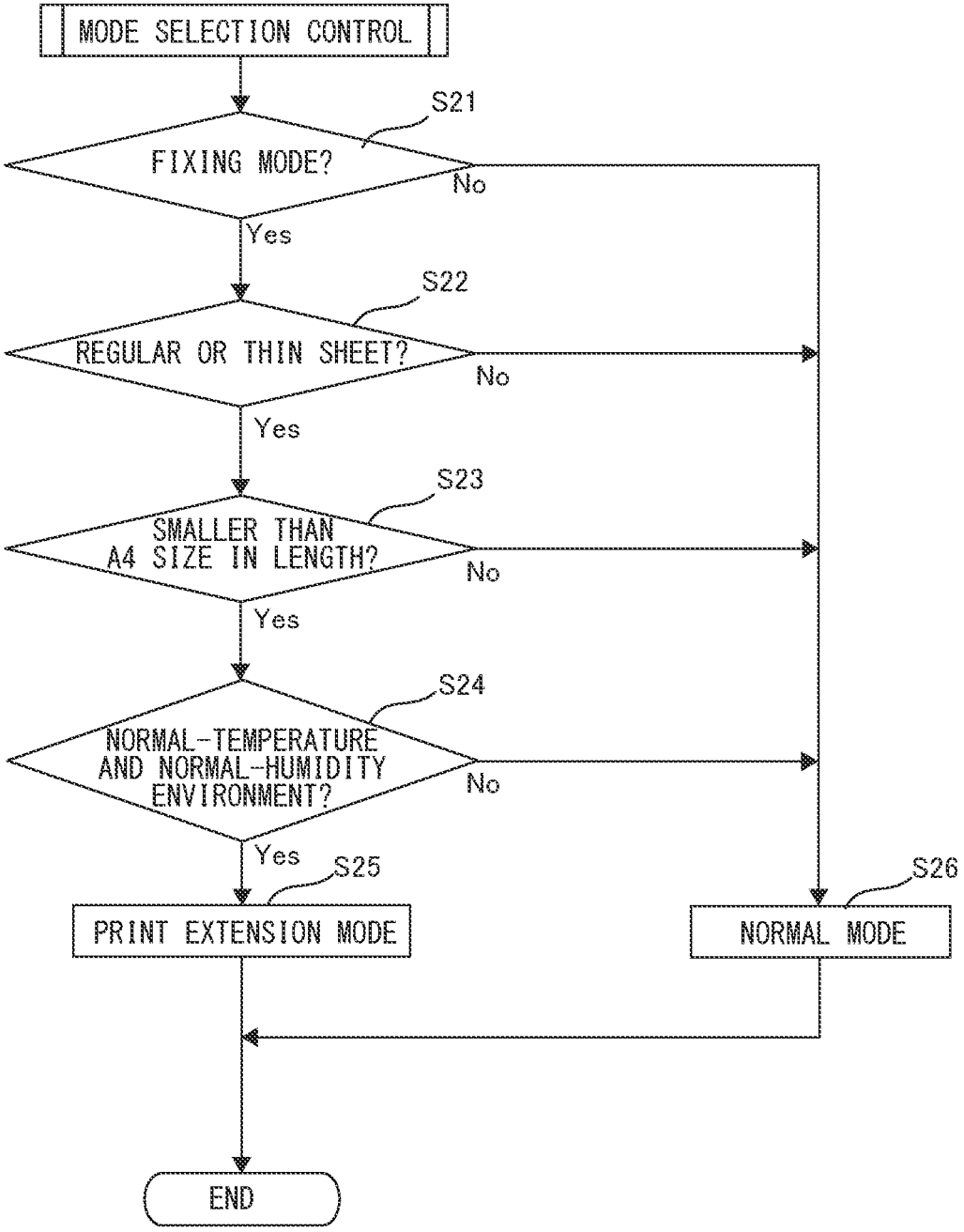
FIG. 8 is a flowchart illustrating mode selection control.

Next, the full-load detection control of the present embodiment will be described with reference to FIGS. 7 to 9B. FIG. 7 illustrates, as an example, the full-load detection control performed in a job for forming images on a plurality of sheets and for successively discharging the sheets to the discharging tray 13. FIG. 8 is a flowchart illustrating mode selection control that is a subflow of the full-load detection control. As illustrated in FIG. 7, upon receiving a print start command in the standby state, the control portion 80 starts to perform the printing operation on the sheet S (Step S1).

Then the control portion 80 determines whether the state of the full-load detection sensor 24 is in an ON state (Step S2). As described above, if sheets are sequentially discharged to the discharging tray 13 by the discharging nip 15 of the discharging roller unit 31 and the height of the stacked sheets SS increases, the flag portion 23 of the full-load detection member 50 moves from the standby position toward the detection position and the below-described upper position (see FIG. 9A). If the control portion 80 determines that the state of the full-load detection sensor 24 is not the ON state (Step S2: No), then the control portion 80 controls the discharging roller unit 31 so that the sheet S is discharged following the stacked sheets SS (Step S3). Then the control portion 80 checks whether the control portion 80 has received a next discharging command for discharging the sheet S to the discharging tray 13 (Step S4). If the control portion 80 determines that the control portion 80 has received the next discharging command (Step S4: Yes), then the control portion 80 returns to Step S1. If the control portion 80 determines that the control portion 80 has not received the next discharging command (Step S4: No), then the control portion 80 proceeds to Step S5 and stops the printing operation (Step S5).

If the control portion 80 determines that the state of the full-load detection sensor 24 is in the ON state (Step S2: Yes), then the control portion 80 performs the mode selection control (Step S6). That is, the mode selection control is performed if the full-load detection member 50 reaches the detection position.

By the way, the force that pushes out the sheets SS stacked on the discharging tray 13 tends to increase as the thickness and the grammage of the sheet S discharged by the discharging nip 15 increase. If the force that pushes out the stacked sheets SS increases, the stacked sheets SS will easily fall from the discharging tray 13, so that the sheet stacking performance will deteriorate. For this reason, more sheets S can be stacked on the discharging tray 13 while the sheet stacking performance is kept, as the thickness and the grammage of the sheets S decrease.

In addition, if the length of a sheet in the sheet conveyance direction D1 is larger than a predetermined length, the sheet tends to project outward from the discharging tray 13 when stacked on the discharging tray 13. In this case, the stacked sheet is pushed by the following sheet discharged to the discharging tray 13, and tends to easily fall from the discharging tray 13. For this reason, it is preferable that the sheet S has a length that causes the sheet S not to project outward from the discharging tray 13 in a state where the sheet S is stacked on the discharging tray 13. In the present embodiment, if the sheet S has a size equal to or smaller than the A4 size, the sheet S does not project outward from the discharging tray 13. However, if the sheet S has a size larger than the A4 size, the sheet S will climb over the extension tray 14 disposed on the discharging tray 13, and project outward from the discharging tray 13. For this reason, more sheets S can be stacked on the discharging tray 13 while the sheet stacking performance is kept, if the sheets S have a size equal to or smaller than the A4 size.

In addition, if the interior of the printer 100 or the space around the sheet discharging apparatus 12 is in a high-temperature and high-humidity environment, the water content of the sheet increases. In this case, the coefficient of friction of the sheet increases, so that the force of the sheet discharged from the discharging nip 15 and pushing out the stacked sheets increases. In addition, since the water content of the sheet varies depending on the temperature and the humidity of the ambient environment of the printer 100, the amount of curling of the sheet also varies. For example, the amount of curling of the sheet increases in a low-temperature and low-humidity environment or a high-temperature and high-humidity environment. Thus, the predetermined height is reached with less sheets printed and stacked on the discharging tray 13. For this reason, in the normal-temperature and normal-humidity environment that is advantageous for the coefficient of friction and the amount of curling of the sheet, more sheets S can be stacked on the discharging tray 13.

As described above, the mount (height) of sheets that can be stacked on the discharging tray 13 varies depending on the type (grammage) of the sheets discharged by the discharging nip 15, the length of the sheets in the sheet conveyance direction D1, and the ambient temperature and/or humidity of the sheet discharging apparatus 12.

Thus, in the present embodiment, a normal mode or a print extension mode is selected in the mode selection control, so that the number of sheets that can be stacked on the discharging tray 13 can be increased while the sheet stacking performance of the discharging tray 13 is kept.

As illustrated in FIG. 8, if the mode selection control is executed, the control portion 80 determines whether a fixing mode is selected (Step S21). The fixing mode is a mode in which a user selects a type (grammage) of sheets, such as a thin sheet type, a regular sheet type, or a thick sheet type, for appropriately controlling the temperature of the fixing portion 11 in the printing operation. In the present embodiment, in the fixing mode, a user can specify the type (grammage) of sheets by using, for example, an external PC connected to the printer 100, or the operation portion 85.

If the control portion 80 determines that the fixing mode is not selected (Step S21: No), then the control portion 80 sets the mode to the normal mode (Step S26). In the normal mode, if the full-load detection sensor 24 is in an ON state for a predetermined time or more, the control portion 80 determines that the discharging tray 13 is fully loaded with the stacked sheets SS, and stops the printing operation. That is, in the normal mode that serves as a first mode, if the full-load detection sensor 24 detects that the full-load detection member 50 has reached the detection position, the control portion 80 restricts the discharge of the sheet S performed by the discharging roller unit 31. This operation can prevent the sheet from falling from the discharging tray 13 or being jammed due to overload, while keeping the sheet stacking performance for the sheets stacked on the discharging tray 13.

If the control portion 80 determines that the fixing mode is selected (Step S21: Yes), then the control portion 80 determines whether the type of sheets specified in the fixing mode is a predetermined type. In the present embodiment, the control portion 80 determines whether the type of sheets specified in the fixing mode is a regular sheet type or a thin sheet type (Step S22). As one example, the regular sheets are sheets whose grammage is in a range from 64 to 105 g/m$^2$. The thin sheets may be sheets whose grammage is smaller than 64 g/m$^2$, and the thick sheets may be sheets whose grammage is larger than 105 g/m$^2$. If the control portion 80 determines that the type of the sheet S to be discharged is neither the regular sheet type nor the thin sheet type (Step S22: No), then the control portion 80 sets the mode to the normal mode (Step S26).

If the control portion 80 determines that the type of the sheet S to be discharged is the regular sheet type or the thin sheet type (Step S22: Yes), then the control portion 80 determines whether the length of the sheet S (to be discharged) in the sheet conveyance direction D1 is equal to or smaller than a predetermined length. In the present embodiment, the control portion 80 determines whether the length of the sheet S (to be discharged) in the sheet conveyance direction D1 is equal to or smaller than the A4 size (Step S23). As described with reference to FIG. 6, the length of the sheet S (to be discharged) in the sheet conveyance direction D1 is detected by the sheet-length detection portion 30. If the control portion 80 determines that the length of the sheet S to be discharged is larger than the A4 size (Step S23: No), then the control portion 80 sets the mode to the normal mode (Step S26).

If the control portion 80 determines that the length of the sheet S (to be discharged) in the sheet conveyance direction D1 is equal to or smaller than the A4 size (Step S23: Yes), then the control portion 80 determines whether the environment is a predetermined environment. In the present embodiment, the control portion 80 determines whether the ambient environment is the normal-temperature and normal-humidity environment, depending on the result detected by the environment sensor 25 (Step S24). If the control portion 80 determines that the ambient environment is not the normal-temperature and normal-humidity environment, but the low-temperature and low-humidity environment or the high-temperature and high-humidity environment (Step S24: No), then the control portion 80 sets the mode to the normal mode (Step S26). If the control portion 80 determines that the ambient environment is the normal-temperature and normal-humidity environment (Step S24: Yes), then the control portion 80 sets the mode to the print extension mode (Step S25).

If the control portion 80 ends the mode selection control performed in Step S6 of the flowchart of FIG. 7, then the control portion 80 proceeds to Step S7. In Step S7, the control portion 80 determines whether the mode is set as the print extension mode (Step S7). If the mode is set as not the print extension mode but the normal mode (Step S7: No), then the control portion 80 stops the printing operation (Step S5). That is, if the state of the full-load detection sensor 24 becomes an ON state, the control portion 80 restricts the discharge of the sheet S performed by the discharging roller unit 31.

If the mode is set as the print extension mode (Step S7: Yes), then the control portion 80 determines whether a predetermined number of sheets has been discharged by the discharging roller unit 31 since the full-load detection sensor 24 detected that the full-load detection member 50 had reached the detection position (Step S8). The predetermined number of sheets is a number of sheets printable in the print extension mode. Note that in the present embodiment, the number of sheets printable in the print extension mode is set to a value of 60. However, the present disclosure is not limited to this. For example, the above-described number of sheets printable in the print extension mode may be changed if the sheet S does not fall from the discharging tray 13 and is not jammed.

The number of sheets discharged, in the print extension mode, by the discharging roller unit 31 after the full-load detection member 50 reaches the detection position is counted by the counter 84 of the control portion 80 (the number of sheets is hereinafter referred to as the number of sheets printed in the print extension mode). For example, the number of sheets printed in the print extension mode, counted by the counter 84, is stored in the RAM 83 until the power supply of the printer 100 is turned OFF.

If the control portion 80 determines that all the sheets printable in the print extension mode are not printed (Step S8: No), then the control portion 80 determines whether the control portion 80 has received another sheet print command that has a different condition other than the conditions described in the steps S22 to S24 of FIG. 8 and necessary for selecting the print extension mode (Step S9).

If the control portion 80 determines that the control portion 80 has not received the sheet print command that has the different condition (Step S9: No), then the control portion 80 returns to Step S8. If all the sheets printable in the print extension mode are printed in Step S8 (Step S8: Yes), or if the control portion 80 receives the sheet print command that has the different condition (Step S9: Yes), then the control portion 80 stops the printing operation (Step S5). That is, in the print extension mode, if all the sheets printable in the print extension mode are discharged to the discharging tray 13 by the discharging roller unit 31 after the full-load detection sensor 24 detects that the full-load detection member 50 has reached the detection position, the control portion 80 restricts the discharge of the sheet S performed by the discharging roller unit 31.

Figure 9A:
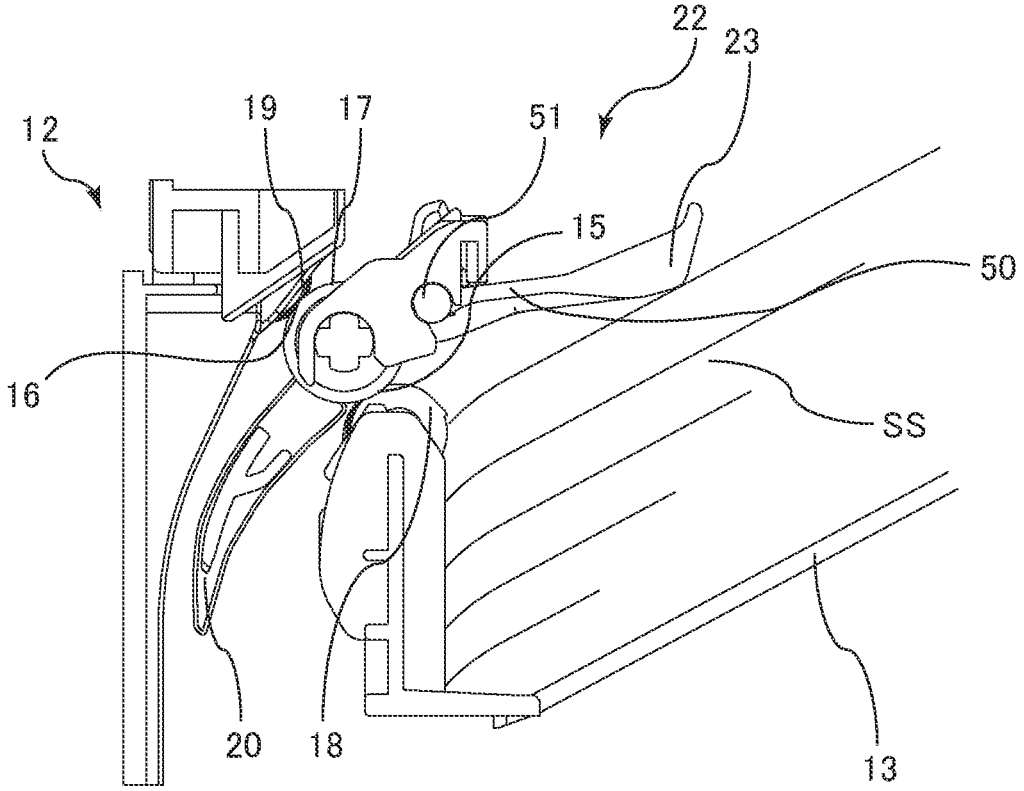
FIG. 9A is a cross-sectional view illustrating the full-load detection member located in an upper position.
Figure 9B:
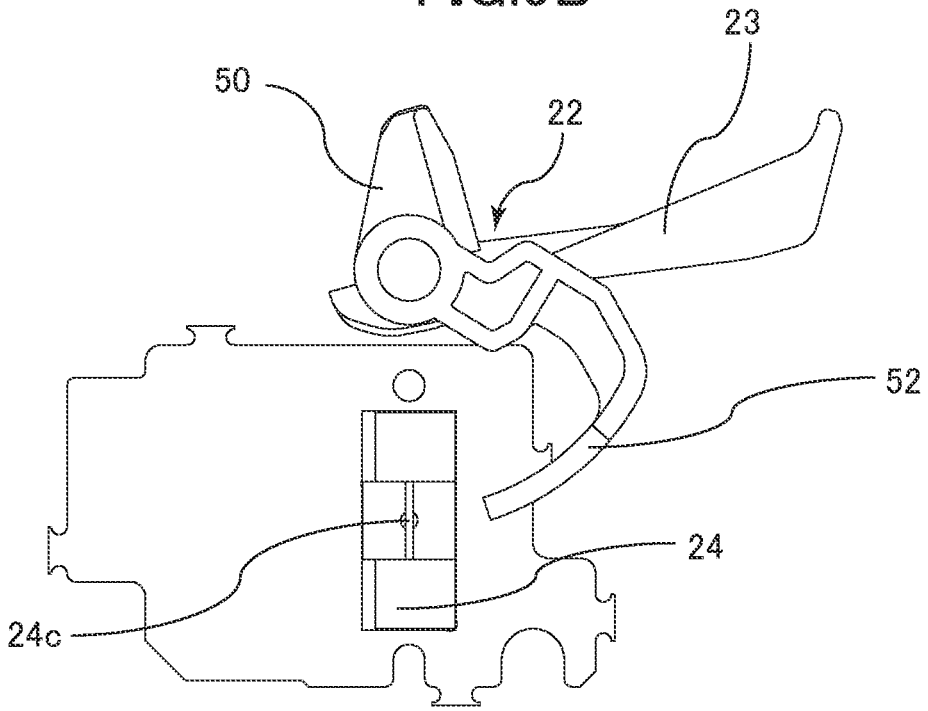
FIG. 9B is a cross-sectional view illustrating the full-load detection member located in the upper position, and the full-load detection sensor.

Each of FIGS. 9A and 9B is a cross-sectional view illustrating the full-load detection member 50 located in the upper position, and the full-load detection sensor 24. The full-load detection member 50 is located in the upper position that serves as a third position, in a state where all the sheets printable in the print extension mode (whose number is 60 in the present embodiment) have been printed. As illustrated in FIGS. 9A and 9B, after the full-load detection member 50 reaches the detection position, the full-load detection member 50 can move to the upper position that is farther from the standby position than the detection position is. That is, as the height of the sheets SS stacked on the discharging tray 13 increases, the full-load detection member 50 transitions in the order of the standby position, the detection position, and the upper position. Even in a case where the full-load detection member 50 is located in the upper position illustrated in FIGS. 9A and 9B, the light blocking portion 52 does not block the optical path 24*c* of the full-load detection sensor 24, and the full-load detection sensor 24 is in an ON state. As described above, in the print extension mode that serves as a second mode, the discharging roller unit 31 is allowed to discharge the sheet S until the number of sheets printed in the print extension mode reaches the number of sheets printable in the print extension mode, even in a state where the full-load detection member 50 is located between the detection position and the upper position. That is, in the print extension mode that serves as a second mode, the discharging roller unit 31 can continue to discharge the sheet S until the number of sheets printed in the print extension mode reaches the number of sheets printable in the print extension mode, even in a state where the full-load detection member 50 is located between the detection position and the upper position.

After stopping the printing operation in Step S5, the control portion 80 determines whether the sheets SS stacked on the discharging tray 13 has been removed by a user (Step S10). The control portion 80 determines that the stacked sheets SS have been removed by a user, depending on the state of the full-load detection sensor 24 that has changed from the ON state to the OFF state. If the control portion 80 determines that the stacked sheets SS has been removed by a user (Step S10: Yes), then the control portion 80 returns to the standby state.

As described above, in the present embodiment, if the full-load detection sensor 24 detects that the full-load detection member 50 has reached the detection position, the control portion 80 controls the discharging roller unit 31 in the normal mode or the print extension mode. If the full-load detection member 50 retracts from the standby position and moves to the detection position, the output from the full-load detection sensor 24 changes from a first output (OFF) to a second output (ON). If the output from the full-load detection sensor 24 is the second output, the control portion 80 determines that the full-load detection member 50 has reached the detection position. In addition, in a state where the output from the full-load detection sensor 24 is the second output, the control portion 80 controls the discharging roller unit 31 in the normal mode or the print extension mode. In this case, the control portion 80 selects the normal mode or the print extension mode, depending on the type of the sheet discharged by the discharging roller unit 31, the length of the sheet in the sheet conveyance direction D1, and the ambient temperature-and-humidity environment of the sheet discharging apparatus 12. If the print extension mode is selected, the discharging roller unit 31 can continue to discharge the sheets S until the number of sheets printed in the print extension mode reaches the number of sheets printable in the print extension mode. In this case, the number of sheets that can be stacked on the discharging tray 13 can be increased.

In addition, since the sheet stacking performance for the sheets stacked on the discharging tray 13 can be kept even if which of the normal mode and the print extension mode is selected, the sheet S can be prevented from falling from the discharging tray 13 and from being jammed.

Second Embodiment

Next, a second embodiment of the present invention will be described. In the second embodiment, a media sensor 26 is added to the first embodiment. Thus, the same components as those of the first embodiment are omitted in the drawings, or described with the same symbols given to the drawings.

Figure 10:
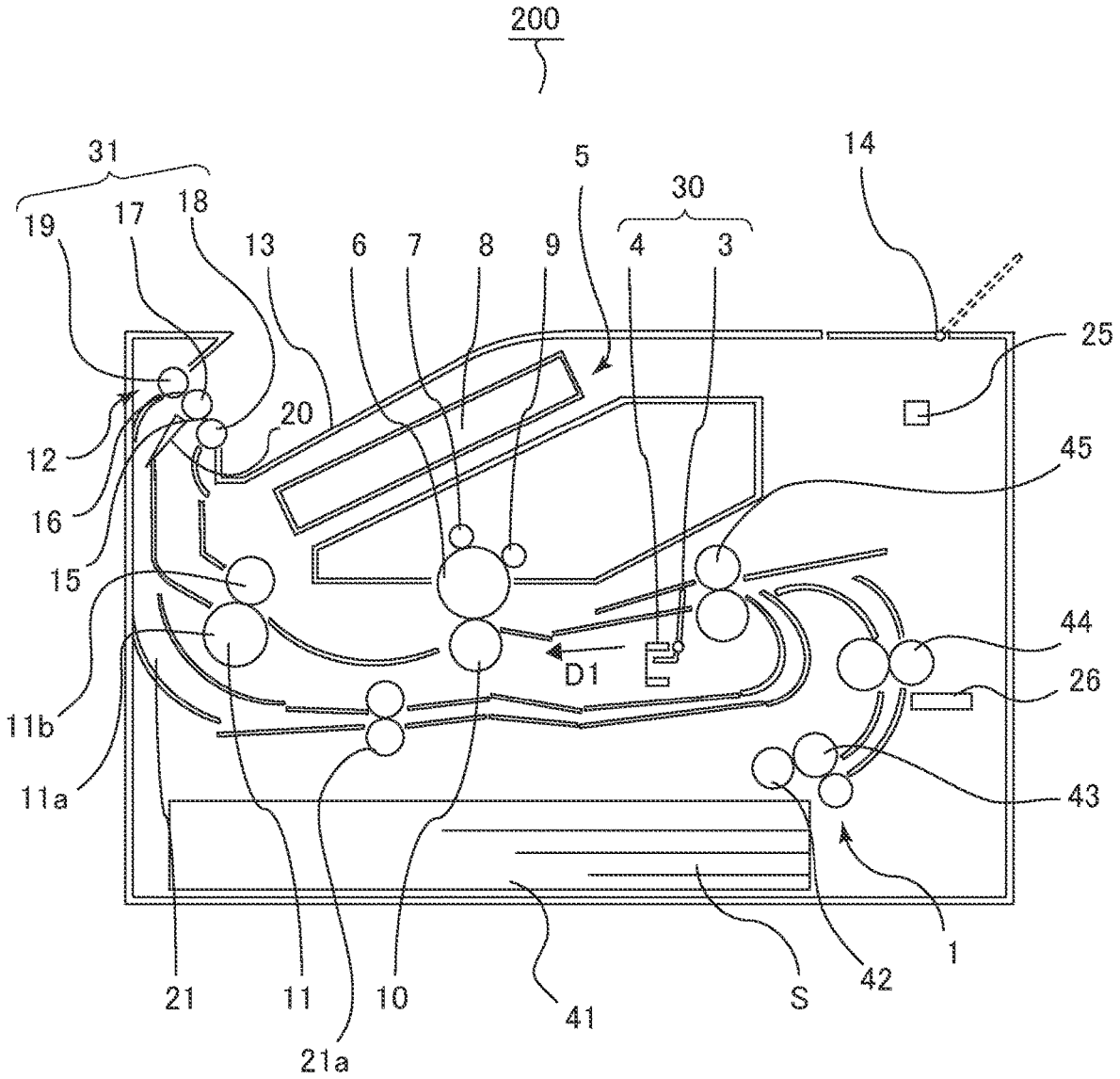
FIG. 10 is an overall schematic diagram illustrating a printer of a second embodiment.

In the above-described first embodiment, in the mode selection control illustrated in FIG. 8, the control portion 80 determines whether to set the mode to the print extension mode, by using the type of the sheet specified in the fixing mode. However, as illustrated in FIG. 10, a printer 200 of the second embodiment determines the type of the sheet S by using a sensor that can detect the type of the sheet S. In the present embodiment, the printer 200 determines the type of the sheet S by using the media sensor 26 that can detect the thickness of the sheet S. For example, the media sensor 26 includes two phototransistors. One of the phototransistors detects the light emitted from the light source to the sheet and reflected from the sheet, and the other detects the light emitted from the light source to the sheet and having passed through the sheet. The media sensor 26 may be an ultrasonic sensor.

As illustrated in FIG. 10, in the present embodiment, the media sensor 26 is disposed between the separation roller pair 43 and the conveyance roller pair 44 in the sheet conveyance direction D1. However, the present disclosure is not limited to this. For example, the media sensor 26 may detect the thickness of the sheet S conveyed, at a position positioned downstream of the conveyance roller pair 44 in the sheet conveyance direction D1.

Figure 11:
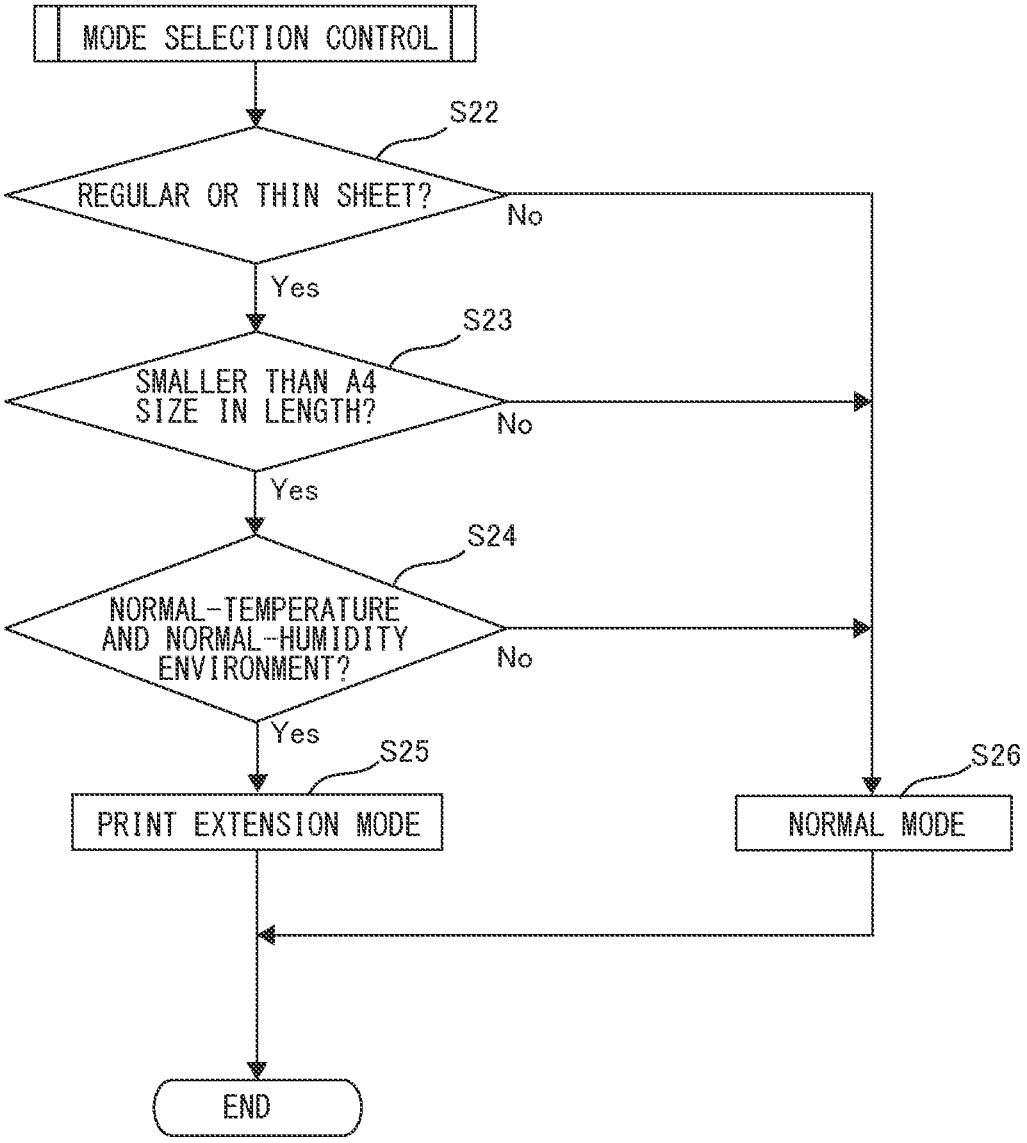
FIG. 11 is a flowchart illustrating mode selection control.

FIG. 11 is a flowchart illustrating mode selection control of the second embodiment. The flowchart illustrated in FIG. 11 is the same as the flowchart illustrated in FIG. 8 except that Step S21 of FIG. 8 is removed. The main flow (see FIG. 7) of the full-load detection control is the same as that of the first embodiment. In Step S22, the control portion 80 determines whether the type of the sheet S is a regular sheet type or a thin sheet type, depending on the thickness of the sheet S detected by the media sensor 26 (Step S22).

As described above, in the present embodiment, since the media sensor 26 is used, a user does not have to select the type of the sheet, such as a thin sheet type, a regular sheet type, or a thick sheet type. As a result, the usability can be increased.

Note that although the media sensor 26 detects the thickness of the sheet S in the present embodiment, the present disclosure is not limited to this. For example, the media sensor 26 may detect the grammage, the surface roughness, or the gloss level of the sheet S. In this case, the control portion 80 may determine whether to set the mode to the print extension mode, depending on the result detected by the media sensor 26.

Third Embodiment

Next, a third embodiment of the present invention will be described. In the third embodiment, the mode selection control of the first embodiment is changed. Thus, the same components as those of the first embodiment are omitted in the drawings, or described with the same symbols given to the drawings.

In the above-described first and second embodiments, the number of sheets printable in the print extension mode is a fixed number. In the present embodiment, however, the control portion 80 determines the number $X_n$ of sheets printable in the print extension mode, depending on the type of the sheet discharged by the discharging roller unit 31, the length of the sheet in the sheet conveyance direction D1, and the ambient temperature-and-humidity environment of the sheet discharging apparatus 12.

Figure 12:
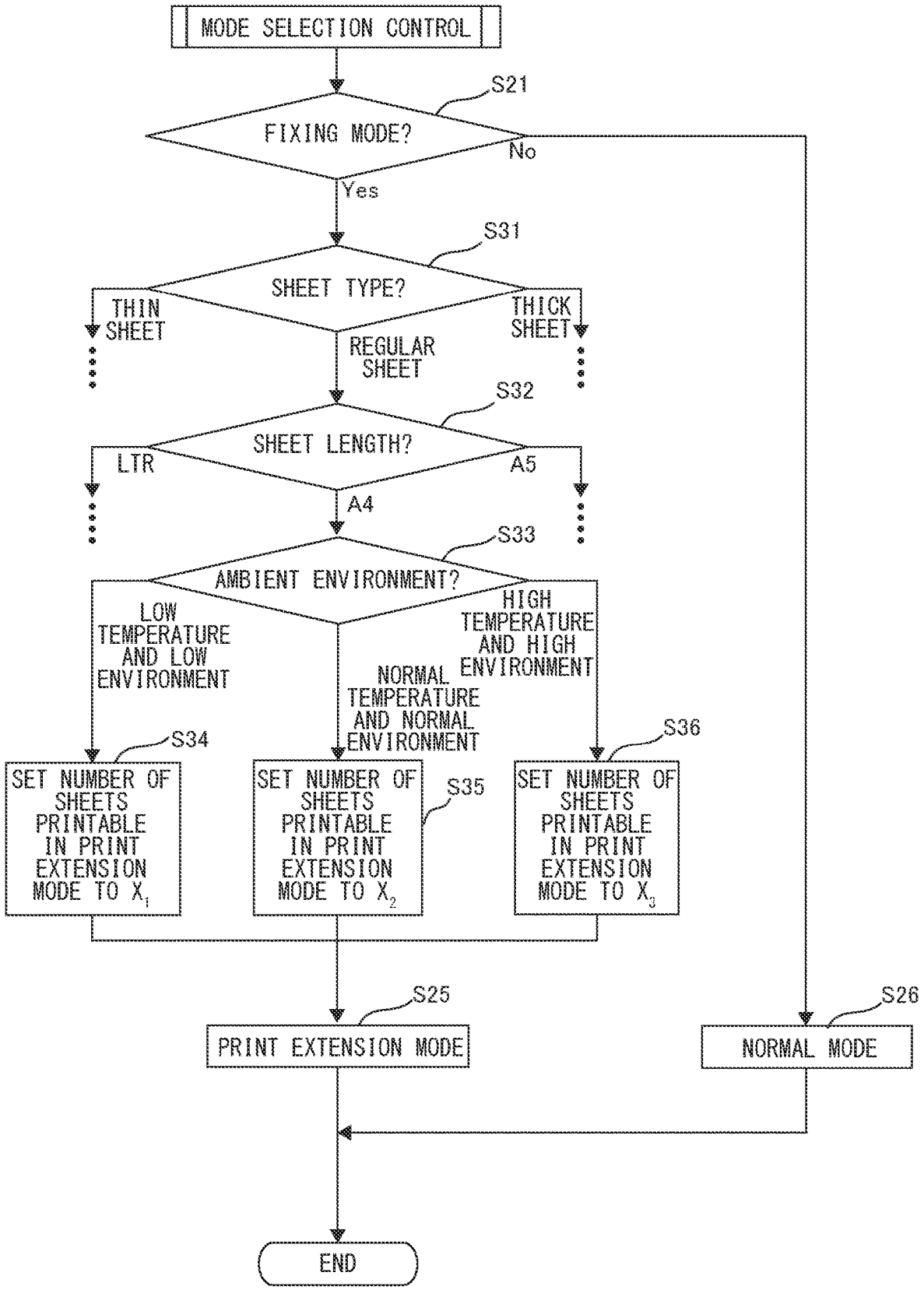
FIG. 12 is a flowchart illustrating mode selection control of a third embodiment.

FIG. 12 is a flowchart illustrating mode selection control of the third embodiment. The main flow (see FIG. 7) of the full-load detection control is the same as that of the first embodiment. As illustrated in FIG. 12, if the mode selection control is executed, the control portion 80 determines whether the fixing mode is selected (Step S21). If the control portion 80 determines that the fixing mode is not selected (Step S21: No), then the control portion 80 sets the mode to the normal mode (Step S26).

If the control portion 80 determines that the fixing mode is selected (Step S21: Yes), then the control portion 80 determines the type of the sheet S to be discharged, depending on the type of the sheet specified in the fixing mode (Step S31). In the present embodiment, the types of sheets S are grouped into three types: a thin sheet type, a regular sheet type, and a thick sheet type. However, the present disclosure is not limited to this. That is, the types of sheets have only to be grouped into two or more types.

For example, if the type of sheets is the regular sheet type (Step S31: regular sheet type), then the control portion 80 determines the length of the sheet in the sheet conveyance direction D1 (Step S32). The length of the sheet S is detected by the sheet-length detection portion 30 (see FIG. 1). In the present embodiment, the lengths of the sheet are grouped into three types: the LTR size, the A4 size, and the A5 size. However, the lengths of the sheet may be grouped into other types that include the LGL size and the B5 size in addition to the above-described sizes. That is, the lengths of the sheet have only to be grouped into two or more types.

For example, if the length of the sheet is the A4 size (Step S32: A4 size), then the control portion 80 determines the ambient temperature-and-humidity environment, depending on the result detected by the environment sensor 25 (Step S33). In the present embodiment, ambient temperature-and-humidity environments are grouped into three environments: a normal-temperature and normal-humidity environment, a high-temperature and high-humidity environment, and a low-temperature and low-humidity environment. However, the ambient temperature-and-humidity environments have only to be grouped into two or more environments.

If the control portion 80 determines that the ambient temperature-and-humidity environment is the low-temperature and low-humidity environment (Step S33: low-temperature and low-humidity environment), then the control portion 80 sets the number of sheets printable in the print extension mode, to a number $X_1$ (Step S34). If the control portion 80 determines that the ambient temperature-and-humidity environment is the normal-temperature and normal-humidity environment (Step S33: normal-temperature and normal-humidity environment), then the control portion 80 sets the number of sheets printable in the print extension mode, to a number $X_2$ (Step S35). If the control portion 80 determines that the ambient temperature-and-humidity environment is the high-temperature and high-humidity environment (Step S33: high-temperature and high-humidity environment), then the control portion 80 sets the number of sheets printable in the print extension mode, to a number $X_3$ (Step S36).

After the steps S33 to S36, the control portion 80 sets the mode to the print extension mode (Step S25), and ends the mode selection control. Although not described above, the number of sheets printable in the print extension mode is also set under the conditions of the steps S32 and S33 even if the control portion 80 determines that the type of the sheet is a thin sheet type (Step S31: thin sheet type) or a thick sheet type (Step S31: thick sheet type). That is, in the present embodiment, the total of combinations of the type of sheets, the length of sheets, and the ambient environment is 27 (=3×3×3). Thus, the number of sheets printable in the print extension mode can be set for each combination. That is, also in the present embodiment, in the print extension mode that serves as a second mode, the discharging roller unit 31 can continue to discharge the sheet S until the number of sheets printed in the print extension mode reaches the number of sheets printable in the print extension mode, even in a state where the full-load detection member 50 is located between the detection position and the upper position.

As described above, in the present embodiment, the number of sheets printable in the print extension mode can be set in consideration of the characteristics of the sheet S and the ambient environment, in a more detailed manner; and the number of sheets that can be stacked on the discharging tray 13 can be increased.

Note that although the control portion 80 initially determines whether the fixing mode is selected, in the mode selection control of the present embodiment, the present disclosure is not limited to this. For example, as in the second embodiment, the control portion 80 may not execute Step S21, and may determine the type of the sheet by using the media sensor 26.

Other Embodiments

In the above-described embodiments, the control portion 80 selects the normal mode or the print extension mode, depending on the type of the sheet discharged by the discharging nip 15, the length of the sheet in the sheet conveyance direction D1, and the ambient temperature and humidity around the sheet discharging apparatus 12. However, the present disclosure is not limited to this. For example, the control portion 80 may select the normal mode or the print extension mode, depending on at least one of the type (grammage) of the sheet discharged by the discharging nip 15, the length of the sheet in the sheet conveyance direction D1, and the ambient temperature and humidity around the sheet discharging apparatus 12. For example, the control portion 80 may select the normal mode (Step S26) if the grammage of the sheet discharged by the discharging nip 15 is larger than a predetermined value of 105 g/m$^2$, and select the print extension mode (Step S25) if the grammage of the sheet is equal to or smaller than 105 g/m$^2$. In another case, the control portion 80 may select the print extension mode (Step S25) if the grammage of the sheet is equal to or smaller than 105 g/m$^2$ and the length of the sheet in the sheet conveyance direction D1 is equal to or smaller than the A4 size, which is a predetermined size. In another case, the control portion 80 may select the print extension mode (Step S25) if the grammage of the sheet is equal to or smaller than 105 g/m$^2$, the length of the sheet in the sheet conveyance direction D1 is equal to or smaller than the A4 size, which is a predetermined size, and the ambient temperature of the sheet discharging apparatus 12 is in a predetermined range (e.g., a range equal to or higher than 19° C. and equal to or lower than 27° C.). The grammage of the sheet, the length of the sheet, and the ambient temperature of the sheet discharging apparatus 12, which serve as thresholds, may be set as appropriate.

In addition, in the above-described embodiments, the full-load detection sensor 24 is constituted by the photointerrupter that includes the light emitting portion 24*a* and the light receiving portion 24*b*. However, the present disclosure is not limited to this. For example, the full-load detection sensor 24 may be a component, such as a switch, whose output value changes if the component is pressed by the full-load detection member 50.

In addition, in the above-described embodiments, the full-load detection member 50 can pivot on the pivot shaft 51. However, the present disclosure is not limited to this. For example, the full-load detection member 50 may slide in the vertical direction.

In addition, in the above-described embodiments, the sheet S is discharged to the discharging tray 13 by the discharging roller unit 31. However, the present disclosure is not limited to this. For example, instead of the discharging roller unit 31, a discharging roller pair and a reversing roller pair may be disposed separately from each other. The discharging roller pair discharges the sheet S to the discharging tray 13, and the reversing roller pair reverses the conveyance direction of the sheet S, toward the duplex conveyance portion 21. If the double-side printing is not performed in the configuration, only the discharging roller pair may be disposed instead of the discharging roller unit 31, for discharging the sheet S to the discharging tray 13.

In addition, in the above-described embodiments, the mode selection control (Step S6) is executed after Step S2. However, the present disclosure is not limited to this. For example, the mode selection control (Step S6) may be executed before Step S2.

In addition, in the above-described embodiments, the description has been made for the electrophotographic printer 100, as one example of image forming apparatuses. However, the present invention is not limited to this. Examples of the image forming apparatuses include a printer, a copying machine, a facsimile, and a multifunction printer; and each of the image forming apparatuses forms images on sheets, used as a recording medium, in accordance with image information sent from an external PC or read from a document. In addition, there is a case in which an attachment apparatus, such as an option feeder, an image reading apparatus, or a sheet processing apparatus, is attached to the body of the image forming apparatus, which has the image forming function. In this case, the whole system in which the attachment apparatus is attached to the body is also a type of the image forming apparatuses.

In addition, although the direct-transfer image forming portion 5 is used, in the present embodiment, for directly transferring an image from the photosensitive drum 6 to the sheet S, the present disclosure is not limited to this. For example, an intermediate-transfer image forming portion may be used. In this case, a toner image is primary-transferred from the photosensitive drum to an intermediate transfer member, and then the toner image is secondary-transferred from the intermediate transfer member to the sheet S. In addition, the image forming portion 5 may form an image by forming toner images on a plurality of photosensitive drums by using toners with different colors, and by superposing the toner images on the sheet.

The present invention may be embodied by providing a program, which achieves one or more functions of the above-described embodiments, to a system or an apparatus via a network or a storage medium, and by causing one or more processors of the system or the apparatus to read and execute the program. In addition, the present invention may be embodied by a circuit (for example, an ASIC) that achieves one or more functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-030437, filed on Feb. 28, 2023, which is hereby incorporated by reference herein in its entirety.

What is claimed is:

1. A sheet discharging apparatus comprising:

a discharging portion configured to discharge a sheet;

a stacking portion on which the sheet discharged by the discharging portion is stacked;

a moving member configured to abut against the sheet stacked on the stacking portion and move to a first position, a second position, and a third position that is farther from the first position than the second position is;

a detection portion configured to detect a position of the moving member; and a control portion configured to control the discharging portion, wherein the moving member is configured to move from the first position toward the second position and the third position as a height of sheets stacked on the stacking portion increases, wherein in a case where the detection portion detects that the moving member has reached the second position, the control portion controls the discharging portion in a first mode or a second mode, the first mode being a mode in which the control portion restricts discharge of a sheet performed by the discharging portion, the second mode being a mode in which the control portion allows the discharging portion to continue to discharge sheets even if the moving member is located between the second position and the third position, wherein in the second mode, the control portion restricts the discharge of a sheet after a predetermined number of sheets has been discharged to the stacking portion by the discharging portion since the detection portion detected that the moving member had reached the second position, and wherein the control portion is configured to determine the predetermined number of sheets, depending on a type of the sheet discharged by the discharging portion, a length of the sheet in a sheet conveyance direction, and temperature and/or humidity.

2. The sheet discharging apparatus according to claim 1, further comprising:

an operation portion configured to allow a user to specify the type of the sheet discharged by the discharging portion;

a sheet-length detection portion configured to detect the length of the sheet in the sheet conveyance direction; and an environment sensor configured to detect the temperature and/or the humidity.

3. The sheet discharging apparatus according to claim 1, further comprising:

a media sensor configured to detect the type of the sheet discharged by the discharging portion;

a sheet-length detection portion configured to detect the length of the sheet in the sheet conveyance direction; and an environment sensor configured to detect the temperature and/or the humidity.

4. The sheet discharging apparatus according to claim 1, wherein the detection portion includes:

a light emitting portion configured to emit light; and a light receiving portion configured to receive the light emitted from the light emitting portion, and wherein the moving member includes:

an abutment portion configured to abut against the sheet stacked on the stacking portion; and a light blocking portion configured to move together with the abutment portion and block the light emitted from the light emitting portion toward the light receiving portion.

5. The sheet discharging apparatus according to claim 1, wherein the moving member is configured to pivot around a pivot shaft, from the first position toward the second position and the third position.

6. The sheet discharging apparatus according to claim 1, wherein the moving member is configured not to abut against the sheets stacked on the stacking portion in the first position in a case where a height of the sheets is smaller than a predetermined height.

7. An image forming apparatus comprising:

an image forming portion configured to form an image on a sheet;

a discharging portion configured to discharge the sheet on which the image is formed by the image forming portion;

a stacking portion on which the sheet discharged by the discharging portion is stacked;

a moving member configured to abut against the sheet stacked on the stacking portion and move to a first position, a second position, and a third position that is farther from the first position than the second position is;

a detection portion configured to detect a position of the moving member; and a control portion configured to control the discharging portion, wherein the moving member is configured to move from the first position toward the second position and the third position as a height of sheets stacked on the stacking portion increases, wherein in a case where the detection portion detects that the moving member has reached the second position, the control portion controls the discharging portion in a first mode or a second mode, the first mode being a mode in which the control portion restricts discharge of a sheet performed by the discharging portion, the second mode being a mode in which the control portion allows the discharging portion to continue to discharge sheets even if the moving member is located between the second position and the third position, wherein in the second mode, the control portion restricts the discharge of a sheet after a predetermined number of sheets has been discharged to the stacking portion by the discharging portion since the detection portion detected that the moving member had reached the second position, and wherein the control portion is configured to determine the predetermined number of sheets, depending on a type of the sheet discharged by the discharging portion, a length of the sheet in a sheet conveyance direction, and temperature and/or humidity.

* * * * *